US009216597B2

(12) United States Patent
Kurasawa et al.

(10) Patent No.: US 9,216,597 B2
(45) Date of Patent: Dec. 22, 2015

(54) PRINTING APPARATUS AND SHEET PROCESSING APPARATUS

(75) Inventors: Kanto Kurasawa, Kawasaki (JP); Yoshiaki Suzuki, Nagareyama (JP); Toshiaki Tokisawa, Yokohama (JP); Masahito Yoshida, Shiki (JP); Kota Uchida, Kawasaki (JP); Takayuki Okamoto, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 940 days.

(21) Appl. No.: 12/962,001

(22) Filed: Dec. 7, 2010

(65) Prior Publication Data

US 2011/0262153 A1 Oct. 27, 2011

(30) Foreign Application Priority Data

Apr. 22, 2010 (JP) ..... 2010-099149

(51) Int. Cl.
*B41J 11/70* (2006.01)
*B41J 11/00* (2006.01)

(52) U.S. Cl.
CPC ..... *B41J 11/70* (2013.01); *B41J 11/006* (2013.01)

(58) Field of Classification Search
CPC ..... B65H 35/008; B65H 2301/51512; B65H 2301/5151; B65H 2301/515326; B65H 2301/51532; B65H 2301/515; B65H 2301/5153; B65H 19/26; B65H 19/265; B65H 11/703; B65H 11/706; B65H 2301/51432; B65H 2301/517; B65H 2301/5143; B65H 2301/121; B65H 2301/122; B65H 2301/41896; B65H 2301/46178; G03G 15/2035; G03G 15/2071; G03G 2215/00666; G03G 15/6523; G03G 2215/00814; G03G 2215/00552; F26B 13/103; F26B 13/108; F26B 13/14; B41J 11/703
USPC ..... 399/384, 385, 18, 19, 20, 21, 124, 125, 399/114
IPC ..... B65H 19/26; F26B 13/14
See application file for complete search history.

(56) References Cited

U.S. PATENT DOCUMENTS

| | | | | |
|---|---|---|---|---|
| 4,709,872 | A * | 12/1987 | Hammer et al. | 242/421.6 |
| 4,905,381 | A * | 3/1990 | Poterala | 34/634 |
| 5,206,681 | A * | 4/1993 | Otomo et al. | 399/411 |
| 5,420,668 | A * | 5/1995 | Okano | 399/21 |
| 2002/0104451 | A1* | 8/2002 | Lyon et al. | 101/229 |
| 2002/0171726 | A1* | 11/2002 | Ishii et al. | 347/101 |
| 2003/0168796 | A1* | 9/2003 | Suzuki et al. | 270/58.07 |

(Continued)

FOREIGN PATENT DOCUMENTS

| | | | |
|---|---|---|---|
| CN | 1136999 | A | 12/1996 |
| CN | 101100252 | A | 1/2008 |

(Continued)

*Primary Examiner* — Blake A Tankersley
*Assistant Examiner* — Ruben Parco, Jr.
(74) *Attorney, Agent, or Firm* — Canon USA, Inc., IP Division

(57) ABSTRACT

At least one of processing units is capable of being pulled out of a main body of an apparatus during the occurrence of a sheet conveyance jam. A first cutter and a second cutter are arranged in the vicinity of the processing unit. The first cutter is configured to cut the sheet on an upstream of the processing unit. The second cutter is configured to cut the sheet on a downstream thereof. When the processing unit is pulled, the sheet is cut on the upstream and downstream of the processing unit.

8 Claims, 12 Drawing Sheets

(56) References Cited

U.S. PATENT DOCUMENTS

| | | | | |
|---|---|---|---|---|
| 2004/0131406 | A1* | 7/2004 | Ohki et al. | 399/384 |
| 2005/0025514 | A1* | 2/2005 | Kitozaki | 399/88 |
| 2005/0271400 | A1* | 12/2005 | Okamoto et al. | 399/21 |
| 2009/0190982 | A1* | 7/2009 | Yamamoto | 399/406 |

FOREIGN PATENT DOCUMENTS

| | | | | | |
|---|---|---|---|---|---|
| CN | 101497283 | A | | 8/2009 | |
| JP | 07-304220 | A | | 11/1995 | |
| JP | 8-335021 | A | | 12/1996 | |
| JP | 11-249346 | A | | 9/1999 | |
| JP | 11-249646 | A | | 9/1999 | |
| JP | 11249346 | A | * | 9/1999 | G03G 15/00 |
| JP | 11-312554 | A | | 11/1999 | |
| JP | 2001-272892 | A | | 10/2001 | |
| JP | 2002278194 | A | * | 9/2002 | G03G 15/00 |
| JP | 2005-335886 | A | | 12/2005 | |
| JP | 2006-027056 | A | | 2/2006 | |
| JP | 2007-021872 | A | | 2/2007 | |
| JP | 2008-126530 | A | | 6/2008 | |
| JP | 2009-255564 | A | | 11/2009 | |
| JP | 2010-058296 | A | | 3/2010 | |
| JP | 2010-070342 | A | | 4/2010 | |

* cited by examiner

SHEET CONVEYING DIRECTION
8
42
57
S
23
24
43
52
53
30

PRINTING APPARATUS AND SHEET PROCESSING APPARATUS

BACKGROUND OF THE INVENTION

1. Field of the Invention

The present invention relates to a printing apparatus using a continuous sheet.

2. Description of the Related Art

Japanese Patent Laid-Open No. 2008-126530 discloses a printing apparatus that performs duplex printing on both of the front and rear surfaces of a long continuous rolled sheet in an inkjet manner.

Japanese Patent Laid-Open No. 8-335021 discloses a mechanism for pulling a processing unit to perform a jam recovery process when a jam occurs during sheet conveyance in a printing apparatus that prints on a cut sheet. If a jam of a sheet extending over two processing units occurs, the two units are pulled out of an apparatus while the units are being coupled to each other. Thus, the jam recovery process can be performed without tearing the sheet between the units.

In the apparatus disclosed in Japanese Patent Laid-Open No. 2008-126530, consideration is not given to the recovery process performed when it is difficult to convey a sheet because of the occurrence of a jam during sheet conveyance (hereinafter, referred to as "sheet conveyance jam"). Accordingly, if a jam occurs, an operator has to remove the entire sheet in the apparatus and resume printing from the beginning of a print job. In other words, if a jam occurs, the amount of wasted sheet and the amount of wasted ink are large. In addition, it takes much time and effort to perform a jam recovery operation.

In the apparatus disclosed in Japanese Patent Laid-Open No. 8-335021, since a sheet to be used is a cut sheet having a short length in a sheet conveying direction, a single sheet extends over two units at most. In a printing apparatus using a continuous sheet, however, a single continuous sheet extends over many processing units at one time. When a jam occurs, it is not realistic to pull all of the units out of the apparatus while the units are being coupled to one another. If an operator tries to pull one of the units after the occurrence of a jam, the operator cannot smoothly pull the unit because the sheet remaining in a sheet conveying path is caught. If the unit is forced to be pulled, the sheet is forced to be drawn, so that the unit and at least one adjacent unit may be damaged. Alternatively, the sheet may be torn and a piece of the torn sheet may be left in a place from which the piece cannot be removed.

SUMMARY OF THE INVENTION

According to an aspect of the present invention, an apparatus includes a main body, a plurality of processing units including a printing unit disposed in the main body, at least one predetermined processing unit of the processing units being capable of being pulled out of the main body during an occurrence of a sheet conveyance jam, and a first cutter and a second cutter arranged in a vicinity of the predetermined processing unit, the first cutter being configured to cut the sheet on an upstream of the predetermined processing unit, the second cutter being configured to cut the sheet on a downstream thereof.

Further features of the present invention will become apparent from the following description of exemplary embodiments with reference to the attached drawings.

DESCRIPTION OF THE EMBODIMENTS

An inkjet printing apparatus according to an embodiment will be described below. The printing apparatus according to the present embodiment uses a long continuous sheet which is longer than a print unit (called a single page or a unit image) to be repetitively printed on the sheet in a sheet conveying direction. The apparatus is a high speed line printer that supports both of single-side printing and duplex printing. The apparatus is suitable for the field of printing a large number of sheets in, for example, a print laboratory. In this specification, if a plurality of small images, text, and a space are mixed in an area of a single print unit (one page), items included in the area are collectively called a single unit image. Specifically, a unit image means a single print unit (one page) when a plurality of pages are sequentially printed on a continuous sheet. The length of a unit image varies depending on the size of an image to be printed. For example, the length of a large size photograph in the sheet conveying direction is 135 mm and the length of an A4 sheet in the sheet conveying direction is 297 mm.

The present invention is widely applicable to printing apparatuses, such as a printer, a multifunction printer, a copying machine, a facsimile machine, and manufacturing apparatuses for various devices. A printing type is not limited. Any printing type, such as inkjet, electrophotography, thermal transfer, dot impact, or liquid development, is available. The present invention is also applicable to a sheet processing apparatus that performs not only printing but also various processes (recording, processing, applying, irradiation, scanning, and inspection) on a rolled sheet.

Figure 1:
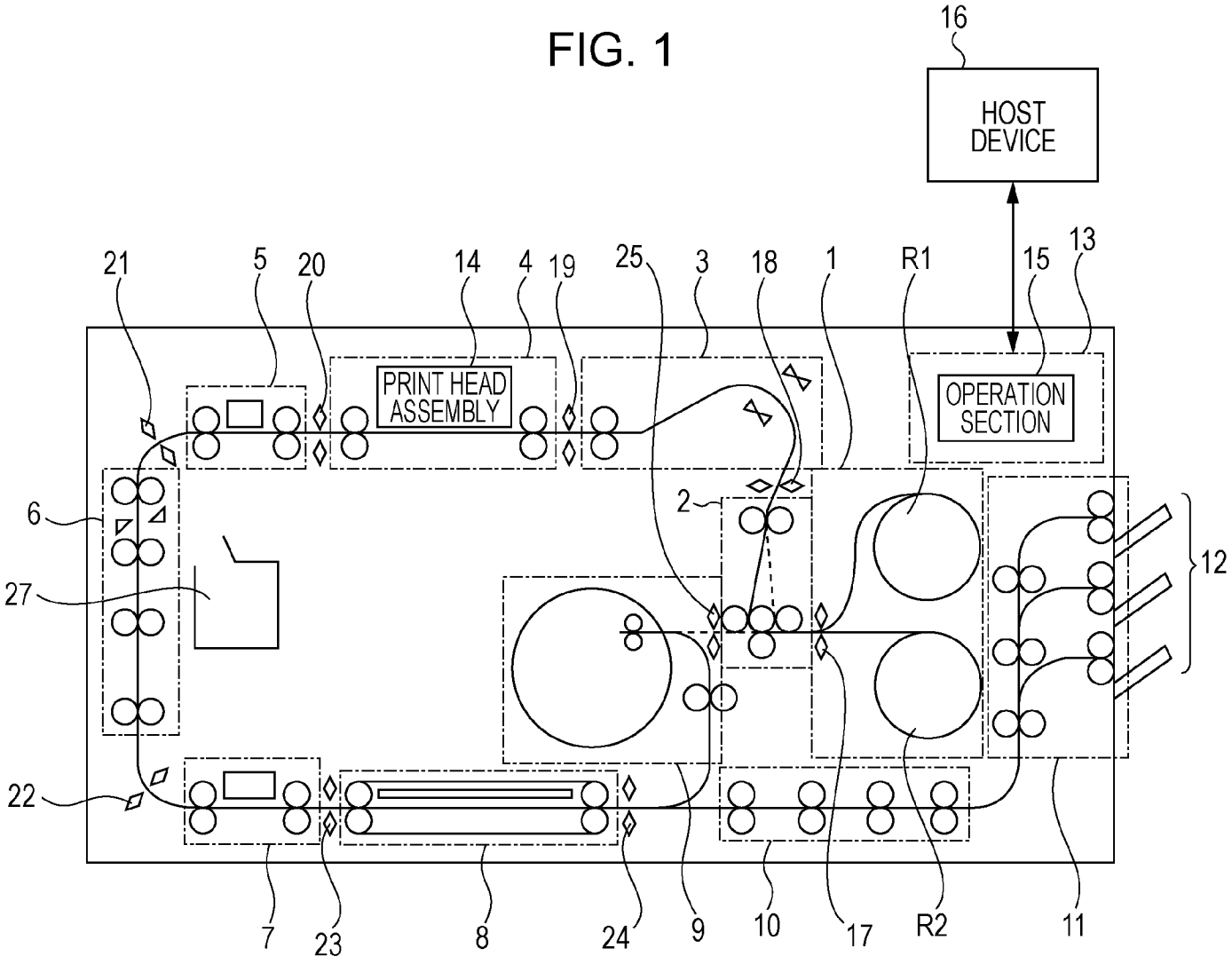
FIG. 1 is a schematic sectional view of the internal structure of a printing apparatus.

FIG. 1 is a schematic sectional view of the internal structure of the printing apparatus. The printing apparatus according to the present embodiment can perform duplex printing, namely, print on both of a first surface of a rolled sheet and a second surface opposite the first surface. A main body of the printing apparatus includes processing units, i.e., a sheet feeding unit 1, a decurling unit 2, a skew correcting unit 3, a printing unit 4, an inspecting unit 5, a cutter unit 6, an information recording unit 7, a drying unit 8, a reverse unit 9, a discharge conveying unit 10, a sorter unit 11, a discharging unit 12, and a control unit 13. These processing units are included in a housing of the main body of the apparatus. The front surface (on the front side of the drawing sheet of FIG. 1) of the housing is provided with a plurality of maintenance doors which are openable and closable independently of each other. The sheet is conveyed along a sheet conveying path indicated by solid lines in FIG. 1 by a conveying mechanism including pairs of rollers and belts and is subjected to processes by the above-described processing units. In an arbitrary position in the sheet conveying path, the side adjacent to the sheet feeding unit 1 will be called "upstream" and the opposite side will be called "downstream".

The sheet feeding unit 1 is configured to hold a rolled continuous sheet and feeds the sheet. The sheet feeding unit 1 can receive two rolls R1 and R2 and is configured to selectively feed the sheet. The number of rolls which can be received is not limited to two. One or three or more rolls may be received. An available sheet is not limited to the rolled sheet so long as the sheet is a continuous sheet. For example, a continuous sheet having perforations arranged at unit lengths may be stacked while being folded at the perforations and may be received in the sheet feeding unit 1.

The decurling unit 2 is configured to reduce curling (warping) of the sheet fed from the sheet feeding unit 1. In the decurling unit 2, two pair of pinch rollers are used relative to one driving roller to curve the sheet so that warping in a direction opposite to the curl is applied to the sheet and the sheet is allowed to pass through the nips. Consequently, a decurling force is applied to the curled sheet, thus reducing the curl. As will be described below, the decurling unit 2 can adjust a decurling force.

The skew correcting unit 3 is configured to correct a skew (inclination relative to the original traveling direction) of the sheet passed through the decurling unit 2. One side, serving as a reference side, of the sheet is urged against a guiding member, thus correcting the skew of the sheet.

The printing unit 4 is configured to perform printing on the conveyed sheet through a print head assembly 14 to form an image on the sheet. In other words, the printing unit 4 is a processing unit configured to perform a predetermined process on the sheet. The printing unit 4 further includes a plurality of conveying rollers for conveying the sheet. The print head assembly 14 includes a line print head assembly including an inkjet nozzle array in a range that covers a maximum width of a sheet to be used. The print head assembly 14 includes a plurality of print heads arranged in parallel to each other in the sheet conveying direction. In this embodiment, the print head assembly 14 includes seven print heads corresponding to seven colors, i.e., cyan (C), magenta (M), yellow (Y), light cyan (LC), light magenta (LM), gray (G), and black (K). The number of colors and the number of print heads are not limited to seven. As for the inkjet type, a type using a heating element, a type using a piezoelectric element, a type using an electrostatic element, or a type using a micro-electro-mechanical system (MEMS) element may be used. Each color ink is supplied from an ink tank through an ink tube to the print head assembly 14.

The inspecting unit 5 includes a scanner that optically scans a test pattern or image printed on the sheet through the printing unit 4, and is configured to inspect, for example, the states of nozzles of the print heads, a sheet conveying state, and the position of the image to determine whether the image is correctly printed. The scanner includes a CCD image sensor or a CMOS image sensor.

The cutter unit 6 includes mechanical automatic cutters to cut the printed sheet having a predetermined length using a driving force from a motor. The present embodiment will be described on the assumption that the cutter unit 6 includes the automatic cutters. The cutter unit 6 further includes a plurality of conveying rollers for conveying the sheet to the subsequent unit for the next processing. A trash bin 27 is provided in the vicinity of the cutter unit 6. The trash bin 27 receives small sheet pieces cut through the cutter unit 6 and discharged as trash. The cutter unit 6 includes a sorting mechanism that sorts cut sheets into different ways, i.e., the trash bin 27 and the original conveying path.

The information recording unit 7 is configured to record print information (information peculiar to each printed image), such as a serial number and the date, in a non-printing area of the cut sheet. Recording is performed such that text or codes are printed in an inkjet manner or a thermal transfer manner.

The drying unit 8 is configured to heat the sheet printed through the printing unit 4 in order to dry the applied ink in a short time. In the drying unit 8, hot air is applied to at least the lower surface of the sheet passing through the drying unit 8 to dry the ink-applied surface of the sheet.

The sheet conveying path from the sheet feeding unit 1 to the drying unit 8 will be called a first path. A portion of the first path between the printing unit 4 and the drying unit 8 is U-shaped. The cutter unit 6 is positioned in the middle of the U-shaped portion.

The reverse unit 9 is configured to temporarily wind the continuous sheet whose front surface has been subjected to printing for duplex printing in order to reverse the sheet. The reverse unit 9 is placed in the middle of a path (loop path), which will be called a second path and extends from the drying unit 8 through the decurling unit 2 to the printing unit 4 and is used to again feed the sheet passed through the drying unit 8 to the printing unit 4. The reverse unit 9 includes a winding rotary member (drum) which rotates to wind and hold the sheet. The continuous sheet whose front surface has been subjected to printing and which is not cut is temporarily wound and held by the winding rotary member. After the sheet is wound, the winding rotary member rotates backward to feed the wound sheet to the decurling unit 2. The sheet is then fed to the printing unit 4. Since the sheet is reversed, the rear surface of the sheet can be subjected to printing through the printing unit 4. A duplex printing operation will be described in more detail later.

The discharge conveying unit 10 is configured to convey the sheet, which has been cut through the cutter unit 6 and been dried through the drying unit 8, to the sorter unit 11. The discharge conveying unit 10 is placed in a path (referred to as a third path) different from the second path in which the reverse unit 9 is provided. To selectively introduce the sheet conveyed through the first path to either of the second path and the third path, a path switching mechanism having a movable flapper is disposed in a branch point between the paths.

The sorter unit 11 and the discharging unit 12 are arranged in the end of the third path such that the units are adjacent to one side of the sheet feeding unit 1. The sorter unit 11 is configured to sort the printed sheets into groups as necessary. The sorted sheets are discharged to the discharging unit 12 including a plurality of trays. As described above, the third path extends below the sheet feeding unit 1 to discharge a sheet to the opposite side of the sheet feeding unit 1 relative to the printing unit 4 and the drying unit 8.

As described above, the units from the sheet feeding unit 1 to the drying unit 8 are sequentially arranged in the first path. The path extending from the drying unit 8 branches into the second path and the third path. In the middle of the second path, the reverse unit 9 is disposed. The second path extending from the reverse unit 9 joins the first path. In the end of the third path, the discharging unit 12 is disposed.

The decurling unit 2, the skew correcting unit 3, the printing unit 4, the inspecting unit 5, the cutter unit 6, the information recording unit 7, the drying unit 8, the reverse unit 9, and the discharge conveying unit 10 are independent processing units. To allow easy maintenance during, for example, a jam recovery operation, an operator can manually pull an arbitrary unit out of the main body of the printing apparatus independently of the other units.

In each of these units, a cutter for cutting the continuous sheet is arranged on each of the upstream and downstream of the unit in the sheet conveying path. The operator can cut the sheet in the vicinities of the upstream and downstream of the unit to be pulled during the jam recovery operation using the cutter, so that the operator can easily pull the unit. These cutters are hand cutters manually manipulated by the operator. Each cutter is driven by a manual force applied by the operator or an actuator in accordance with an instruction of the operator. Referring to FIG. 1, nine hand cutters, i.e., first to ninth cutters 17 to 25 are arranged in nine positions in total in the sheet conveying path in the apparatus. The first cutter 17 is disposed between the sheet feeding unit 1 and the decurling unit 2. Similarly, the second cutter 18 is placed between the decurling unit 2 and the skew correcting unit 3, the third cutter 19 is disposed between the skew correcting unit 3 and the printing unit 4, the fourth cutter 20 is placed between the printing unit 4 and the inspecting unit 5, and the fifth cutter 21 is disposed between the inspecting unit 5 and the cutter unit 6. On the downstream of the cutter unit 6, the sixth cutter 22 is placed between the cutter unit 6 and the information recording unit 7, the seventh cutter 23 is placed between the information recording unit 7 and the drying unit 8, and the eighth cutter 24 is disposed downstream of the drying unit 8 such that the cutter 24 is in the vicinity of the drying unit 8. The ninth cutter 25 is placed between the reverse unit 9 and the decurling unit 2. Since the continuous sheet is not conveyed downstream of the discharge conveying unit 10, it is unnecessary to provide a cutter for cutting the continuous sheet on the downstream of the discharge conveying unit 10.

The control unit 13 is configured to control the units in the printing apparatus. The control unit 13 includes a controller including a central processing unit (CPU), memory units, and various control sections, an external interface (I/F), and an operation section 15 for operator input and output. An operation of the printing apparatus is controlled in accordance with an instruction supplied from the controller or a host device 16, such as a host computer, connected through the external I/F to the controller.

Figure 2:
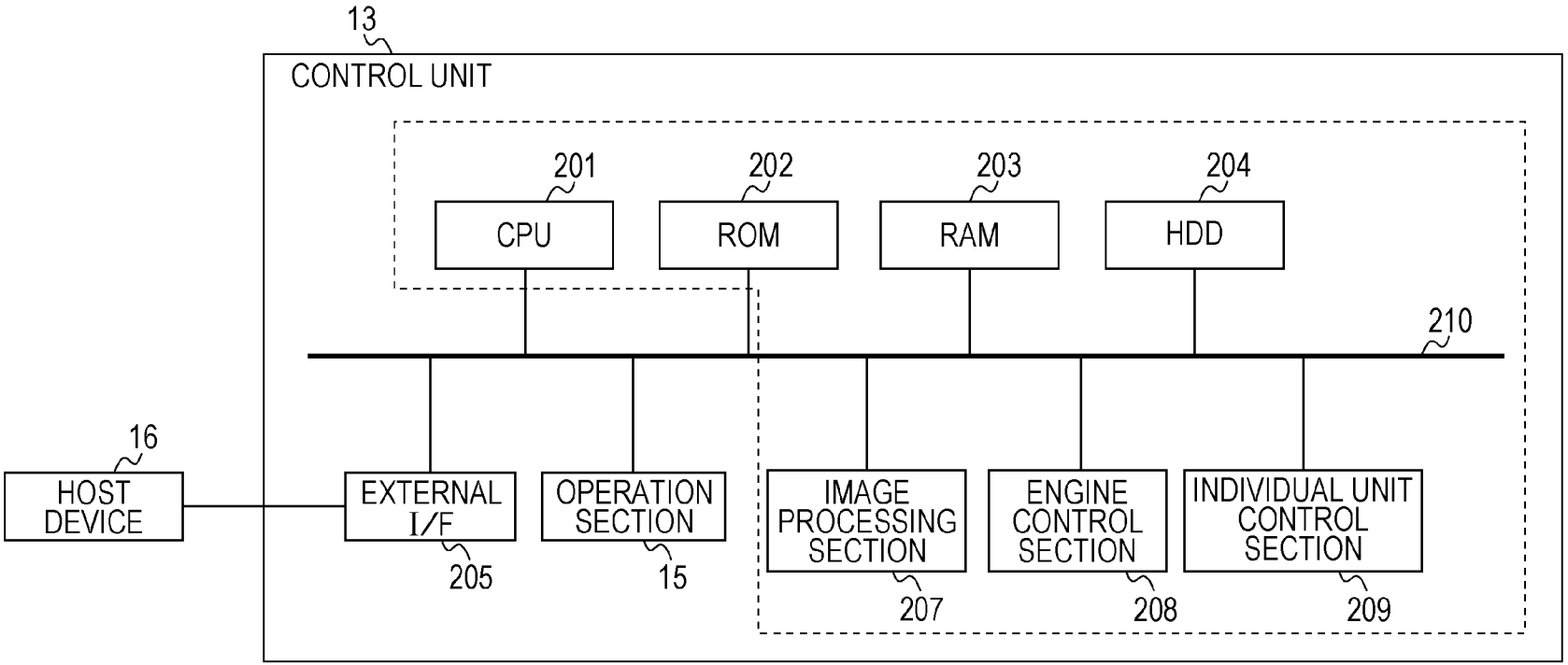
FIG. 2 is a block diagram of a control unit.

FIG. 2 is a block diagram illustrating the concept of the control unit 13. The controller, surrounded by a dashed line, included in the control unit 13 includes the CPU, indicated at 201, a read-only memory (ROM) 202, a random access memory (RAM) 203, a hard disk drive (HDD) 204, an image processing section 207, an engine control section 208, and an individual unit control section 209. The CPU 201 integrally controls operations of the individual units of the printing apparatus. The ROM 202 stores a program to be executed by the CPU 201 and fixed data for various operations of the printing apparatus. The RAM 203 is used as a work area of the CPU 201 and a temporal storage area for various received data items, and also stores various set data items. The HDD 204 stores a program to be executed by the CPU 201, print data, and setting information for various operations of the printing apparatus such that data can be read from the HDD 204. The operation section 15 serves as an input-output interface between the apparatus and the operator and includes an input portion, such as a hard key and a touch panel, and an output portion, such as a display for providing information and an audio generator.

As for the units that perform high-speed data processing, a dedicated processing section is provided for each of these units. The image processing section 207 performs image processing for print data handled by the printing apparatus. For example, the image processing section 207 converts a color space (e.g., YCbCr color space) of input image data to a standard RGB color space (e.g., sRGB color space). Various image processes, such as resolution conversion, image analysis, and image correction, are performed on image data as necessary. The resultant print data subjected to these image processes is stored into the RAM 203 or the HDD 204. The engine control section 208 drives the print head assembly 14 of the printing unit 4 in accordance with print data on the basis of a control command supplied from, for example, the CPU 201. The engine control section 208 also controls conveying mechanisms of the individual units in the printing apparatus. The individual unit control section 209 is a sub-controller for individually controlling the units, i.e., the sheet feeding unit 1, the decurling unit 2, the skew correcting unit 3, the inspecting unit 5, the cutter unit 6, the information recording unit 7, the drying unit 8, the reverse unit 9, the discharge conveying unit 10, the sorter unit 11, and the discharging unit 12. Operations of the units are controlled by the individual unit control section 209 on the basis of instructions from the CPU 201. The external I/F 205 is used to connect the controller to the host device 16 and includes a local I/F or a network I/F. The above-described components are connected by a system bus 210.

The host device 16 serves as a source to supply image data for allowing the printing apparatus to print. The host device 16 may be a general-purpose or dedicated computer, or may be a dedicated image device, such as an image capture, a digital camera, or a photo storage, including an image reader unit. When the host device 16 is a computer, an operating system (OS), application software for generation of image data, and a printer driver for the printing apparatus are installed in a memory unit included in the computer. It is not necessary to realize all of the above-described processes by software. Part or all of the processes may be realized by hardware.

A basic operation upon printing will now be described. Since an operation in a single-side printing mode differs from that in a duplex printing mode, these operations will be described below.

In the single-side printing mode, a sheet fed from the sheet feeding unit 1 is processed by the decurling unit 2 and the skew correcting unit 3. After that, the front surface (first surface) of the sheet is subjected to printing through the printing unit 4. On the long continuous sheet, images (unit images) each having a predetermined unit length in the sheet conveying direction are sequentially printed such that a plurality of formed images are arranged. The printed sheet travels through the inspecting unit 5 and is then cut into sheet segments each having a unit image by the cutter unit 6. As for each cut sheet segment, print information is printed onto the rear surface of the sheet segment by the information recording unit 7 as necessary. The cut sheet segments are conveyed one by one to the drying unit 8 and each sheet segment is dried. After that, the sheet segments are conveyed through the discharge conveying unit 10 and the sorter unit 11 to the discharging unit 12 and are then sequentially discharged and stacked onto the discharging unit 12. On the other hand, the sheet left adjacent to the printing unit 4 upon cutting a sheet segment having the last unit image is fed backward to the sheet feeding unit 1 and is wound onto the roll R1 or R2. As described above, in the single-side printing mode, the sheet is processed while passing through the first and third paths and does not pass through the second path.

On the other hand, in the duplex printing mode, a front-surface (first-side) printing sequence is first performed and a rear-surface (second-side) printing sequence is subsequently performed. In the first front-surface printing sequence, the operations of the units from the sheet feeding unit 1 to the inspecting unit 5 are the same as those during single-side printing described above. In the cutter unit 6, the cutting operation is not performed. The continuous sheet is conveyed as it is to the drying unit 8. The front surface of the sheet applied with ink is dried in the drying unit 8. After that, the sheet is introduced not into the path (third path) to the discharge conveying unit 10 but into the path (second path) to the reverse unit 9. The leading edge of the sheet introduced in the second path is wound onto the winding rotary member of the reverse unit 9 rotating forward (counterclockwise in FIG. 1). When the intended printing on the front surface is completed in the printing unit 4, the continuous sheet is cut at the trailing edge of a printed area on the sheet in the cutter unit 6. The continuous sheet (subjected to printing) downstream of the cut position in the sheet conveying direction is allowed to pass through the drying unit 8 and the entire sheet to the trailing edge (cut position) is then wound by the reverse unit 9. Simultaneously with the winding by the reverse unit 9, the continuous sheet upstream of the cut position (adjacent to the printing unit 4) in the sheet conveying direction is fed backward to the sheet feeding unit 1 so that the leading edge (at the cut position) of the sheet does not remain in the decurling unit 2 and is wound onto the roll R1 or R2. This backward feeding prevents a collision between the left sheet and the sheet to be again fed in the following rear-surface printing sequence.

At the completion of the above-described front-surface printing sequence, the sequence is switched to the rear-surface printing sequence. The winding rotary member of the reverse unit 9 rotates backward (clockwise in FIG. 1), i.e., in the direction opposite to that upon winding the sheet. The end of the wound sheet (the trailing edge of the sheet upon winding becomes the leading edge thereof upon feeding) is fed to the decurling unit 2 along a path indicated by a dashed line in FIG. 1. The decurling unit 2 corrects the curl of the sheet caused by the winding rotary member. Specifically, the decurling unit 2 is disposed between the sheet feeding unit 1 and the printing unit 4 in the first path and is also placed between the reverse unit 9 and the printing unit 4 in the second path. The decurling unit 2 performs decurling in each of the paths and is shared by both the paths. The reversed sheet is conveyed through the skew correcting unit 3 to the printing unit 4 and the rear surface of the sheet is then subjected to printing in the printing unit 4. The printed sheet passes through the inspecting unit 5 and is then cut into sheet segments each having a predetermined unit length in the cutter unit 6. Since both the surfaces of each cut sheet segment are printed, the cut sheet segment is not subjected to recording through the information recording unit 7. The cut sheet segments are conveyed one by one to the drying unit 8. The sheet segments are conveyed through the discharge conveying unit 10 and the sorter unit 11 to the discharging unit 12 and are then sequentially discharged and stacked onto the discharging unit 12. As described above, in the duplex printing mode, the sheet is processed while passing through the first path, the second path, the first path, and the third path in that order.

Figure 3:
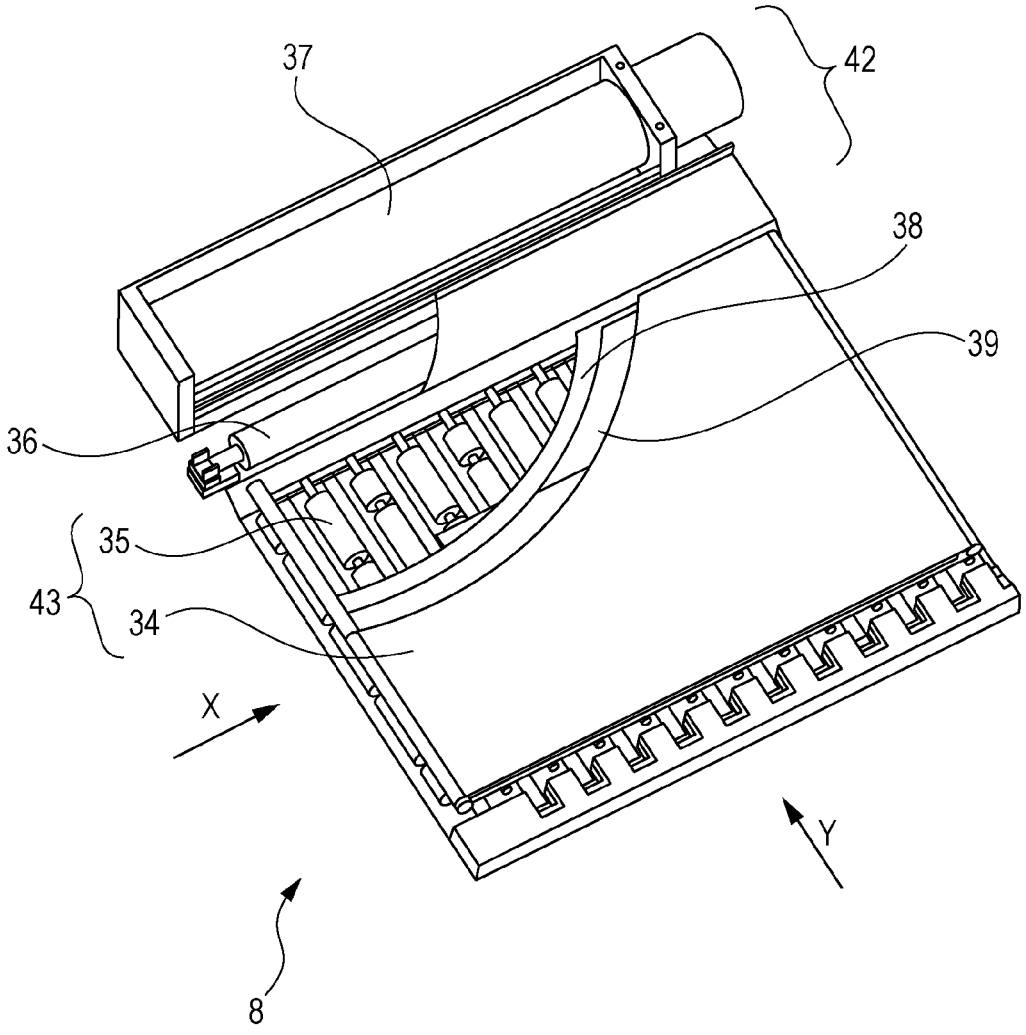
FIG. 3 is a perspective view of a drying unit.

The drying unit 8 in the printing apparatus with the above-described structure will now be described in more detail. FIG. 3 is a perspective view of the internal structure of the drying unit 8. A conveyed sheet applied with ink through the printing unit 4 passes through the cutter unit 6 and the information recording unit 7 and is then introduced into the drying unit 8 in the direction indicated by the arrow X in FIG. 3. The drying unit 8 includes a heater portion 42 and a conveying portion 43. The conveying portion 43 includes a conveying belt 34, serving as an endless belt, applied with a rotational driving force and a plurality of conveying rollers (driven rollers) 35, which face the conveying belt 34 and are arranged in the sheet conveying direction. The distance between two adjacent conveying rollers 35 in the sheet conveying direction is shorter than the length of the smallest cut sheet. Irrespective of whether the sheet introduced into the drying unit 8 is a continuous sheet or a cut sheet, the sheet travels through the drying unit 8 while being sandwiched between the conveying belt 34 and the conveying rollers 35.

The heater portion 42 is configured to circulate hot air in a housing of the drying unit 8 in order to apply the hot air to a sheet. The heater portion 42 includes a heater 36 for raising the temperature of air (i.e., heat the air) to generate hot air and a fan 37 for circulating the hot air to blow the hot air on the sheet. The hot air blown by the fan 37 is ejected upward from the clearances between the conveying rollers 35, so that the hot air is blown on the surface of the sheet. After that, the hot air is returned to the fan 37 and is circulated in the housing.

Inside the conveying belt 34, a heat transfer plate 38 and a surface heating element 39 are arranged such that the plate 38 is integrated with the element 39. Heat generated by the surface heating element 39 propagates through the heat transfer plate 38, serving as a heat transfer element. When the conveying belt 34 is rotated, the inner surface of the conveying belt 34 slides on the surface of the heat transfer plate 38 while being in surface contact with the heat transfer plate 38. This contact allows heat to propagate from the heat transfer plate 38 to the conveying belt 34, so that the temperature of the entire conveying belt 34 is raised. When the sheet is conveyed in the drying unit 8, the outer surface of the conveying belt 34 is in surface contact with the sheet, so that the sheet is heated. Thus, drying the sheet is accelerated. In other words, the hot air is blown on the front surface of the sheet by the heater portion 42 and the rear surface of the sheet is heated by the conveying belt 34, so that both of the surfaces of the sheet are heated. Thus, high-efficiency drying is performed.

Figure 4B:
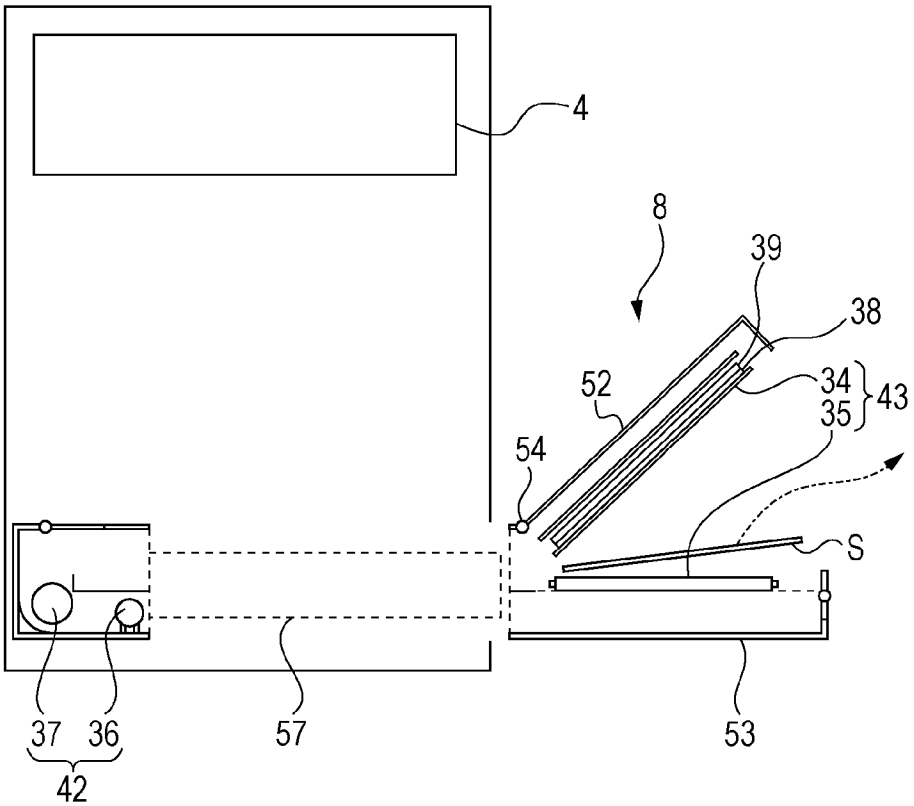
FIGS. 4A and 4B are cross-sectional views of a main body of the printing apparatus.
Figure 4A:
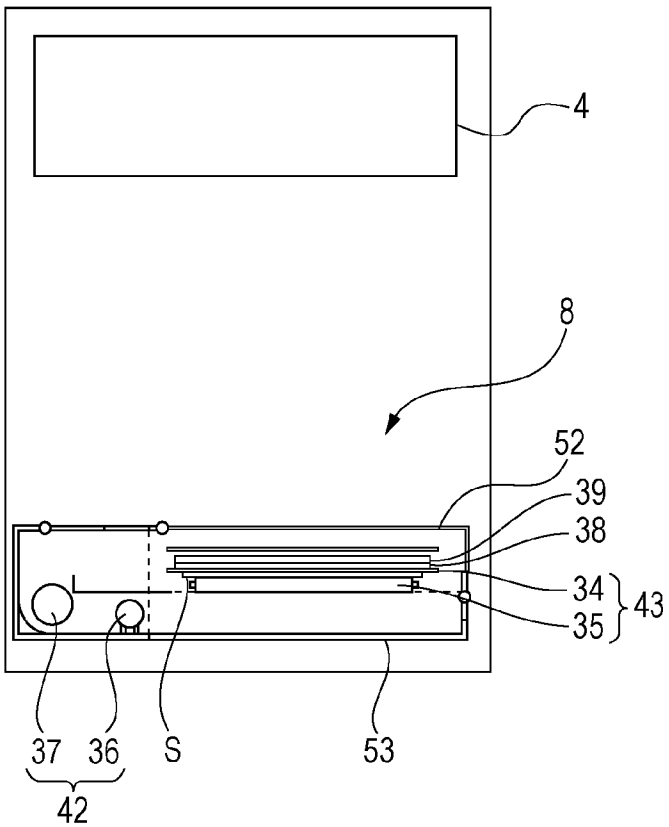

FIGS. 4A and 4B are cross-sectional views of the main body of the printing apparatus and illustrate the section taken at the printing unit 4 and the drying unit 8. The drying unit 8 includes the housing including a first housing segment (upper cover) 52 and a second housing segment (housing main portion) 53. The heater portion 42 and the conveying portion 43 are received in the housing. The heater portion 42 and parts (the conveying rollers) of the conveying portion 43 are held in the second housing segment 53. The first housing segment 52 is openable and closable relative to the second housing segment 53 about a hinge, serving as a fulcrum. FIG. 4A illustrates a state in which the drying unit 8 is received in the main body of the printing apparatus and the first housing segment 52 is closed. FIG. 4B illustrates a state in which the drying unit 8, namely, the first housing segment 52 is opened. Part of the drying unit 8 is slid along rails 57 provided in the main body of the printing apparatus and is pulled out of the printing apparatus (toward the operator side). When the drying unit 8 is pulled as illustrated in FIG. 4B, the drying unit 8 is separated into a unit segment including the conveying portion 43 and a unit segment including the heater portion 42 such that the heater portion 42 remains in the main body of the printing apparatus.

Figure 5:
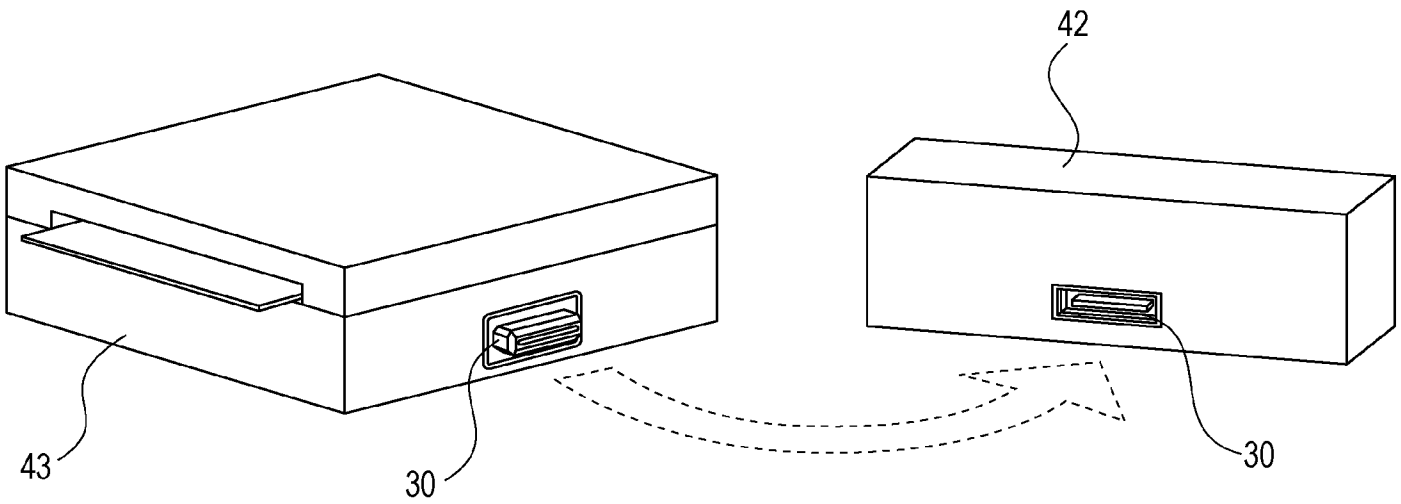
FIG. 5 is a diagram illustrating a state in which portions of the unit are disconnected or to be connected through a drawer connector.

Referring to FIG. 5, the heater portion 42 is electrically connected to the conveying portion 43 through a drawer connector 30. The conveying portion 43 is supplied with power through the drawer connector 30. In addition, the conveying portion 43 is connected to a signal line for control through the drawer connector 30. When the drying unit 8 is attached to the main body of the printing apparatus (the state of FIG. 4A), the connection through the drawer connector 30 is made. When the drying unit 8 is pulled out of the main body of the printing apparatus (the state of FIG. 4B), the connection through the drawer connector 30 is cut. With this arrangement, when the drying unit 8 is pulled, the heater portion 42 at high temperature is not exposed because the portion 42 remains in the main body of the printing apparatus. Accordingly, the operator can easily and securely perform the jam recovery operation.

The first housing segment 52 is rotated about the hinge, indicated at 54, serving as a rotation shaft, provided at the back of the first housing segment 52 in the pulling direction in which the drying unit 8 is pulled, so that a front portion (on the operator side) of the pulled drying unit 8 is opened like the mouth of an alligator. The opened first housing segment 52 is held in an open state by an urging mechanism, such as a gas spring, a hinge spring, or a torsion spring. The first housing segment 52 holds upper parts (the conveying belt 34, the heat transfer plate 38, and the surface heating element 39) of the conveying mechanism of the drying unit 8 and the second housing segment 53 holds lower parts (the conveying rollers 35) of the conveying mechanism. Accordingly, when the first housing segment 52 is opened, the conveying mechanism is separated, so that a sheet S sandwiched between the conveying belt 34 and the conveying rollers 35 is exposed. The operator can easily remove the sheet S.

Figure 6B:
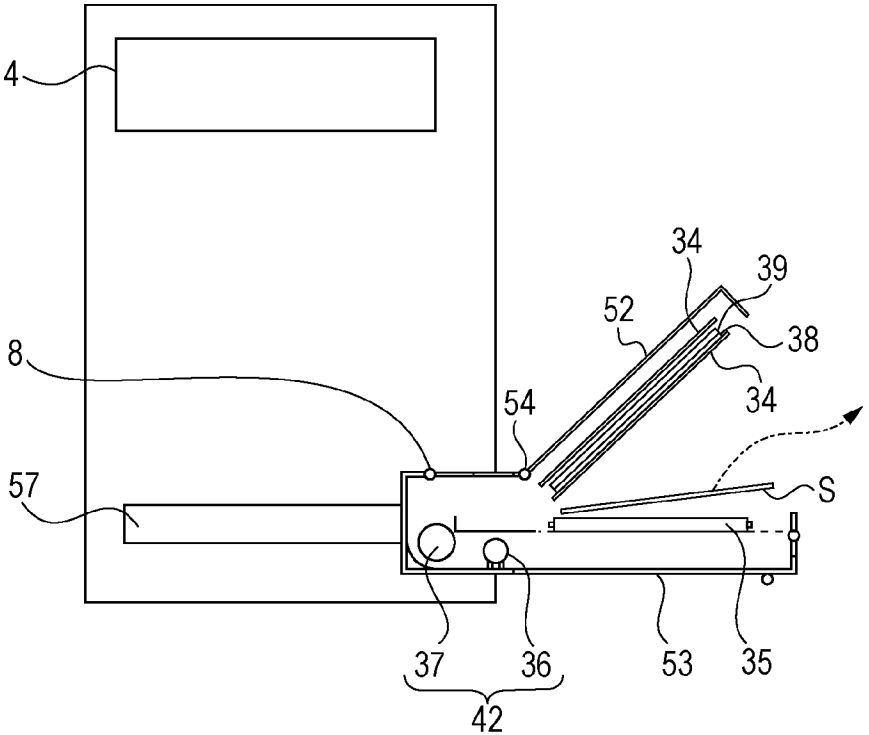
FIGS. 6*a* and 6B are cross-sectional views of a modification of the drying unit illustrated in FIGS. 4A and 4B.
Figure 6A:
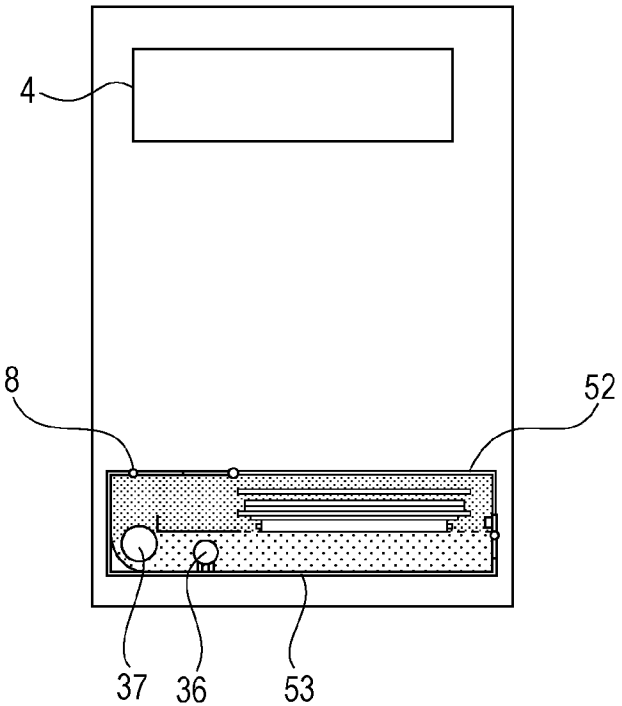
Figure 7A:
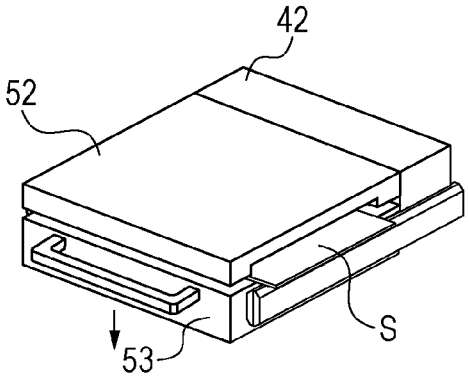
FIGS. 7A and 7B are cross-sectional views of another modification of the drying unit illustrated in FIGS. 4A and 4B.
Figure 7B:
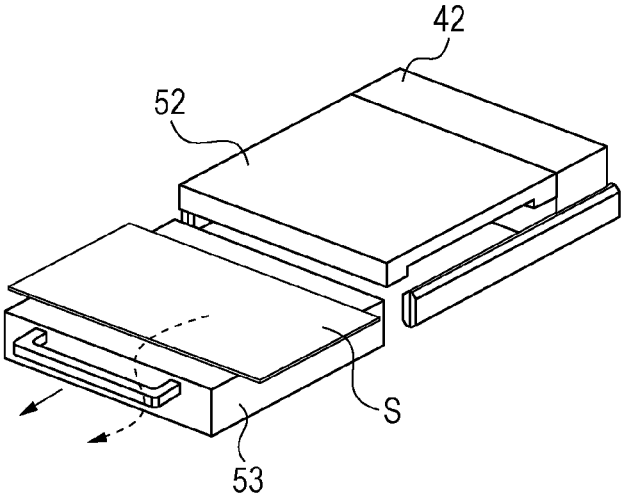

FIGS. 6A and 6B illustrate a modification of the drying unit 8 illustrated in FIGS. 4A and 4B. In this modification, when the drying unit 8 is pulled, the heater portion 42 and the conveying portion 43 are integrally pulled without being separated from each other. The second housing segment 53 holds the heater portion 42 (the heater 36 and the fan 37). The heater portion 42 is further back than the hinge 54 in the pulling direction. Even when the drying unit 8 is fully pulled, most of the heater portion 42 remains in the housing of the main body of the printing apparatus. FIGS. 7A and 7B illustrate another modification of the drying unit 8 illustrated in FIGS. 4A and 4B. The first housing segment 52 and the second housing segment 53 constituting the housing of the drying unit 8 are separated from each other such that they are slid relative to each other. When the drying unit 8 is pulled, the first housing segment 52 remains in the main body of the printing apparatus and the second housing segment 53 alone is pulled, so that the sheet S is exposed. At this time, the heater portion 42 is separated and remains in the housing of the main body of the printing apparatus. In these modifications, when the drying unit 8 is pulled, the heater portion 42 at high temperature is not exposed because it remains in the main body of the printing apparatus. Thus, the operator can easily and securely perform the jam recovery operation.

Figure 8A:
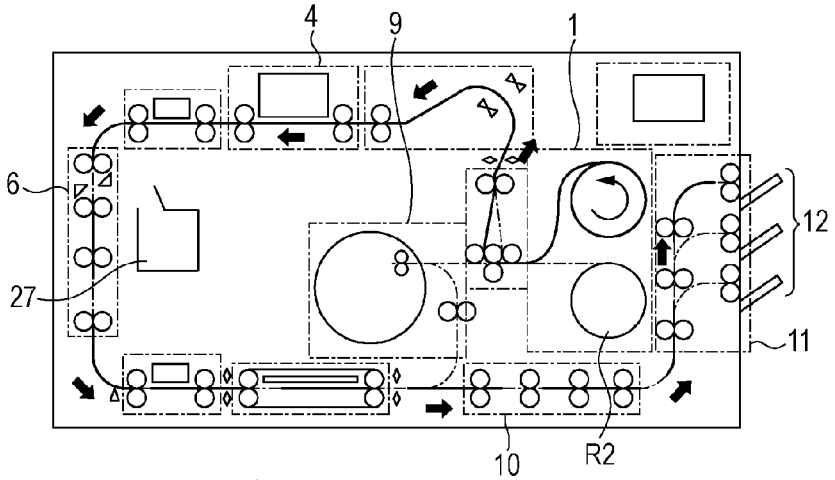
FIGS. 8A to 8C are diagrams illustrating a sheet conveying state during printing in a single-side printing mode and jam states.
Figure 8B:
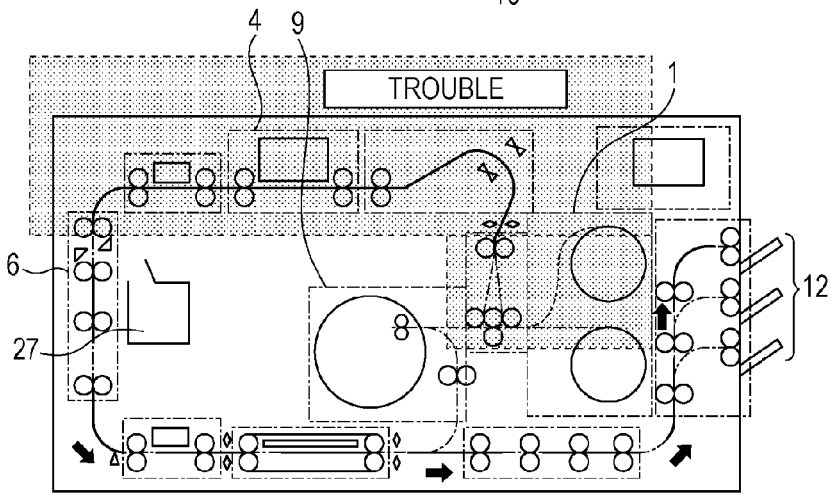
Figure 8C:
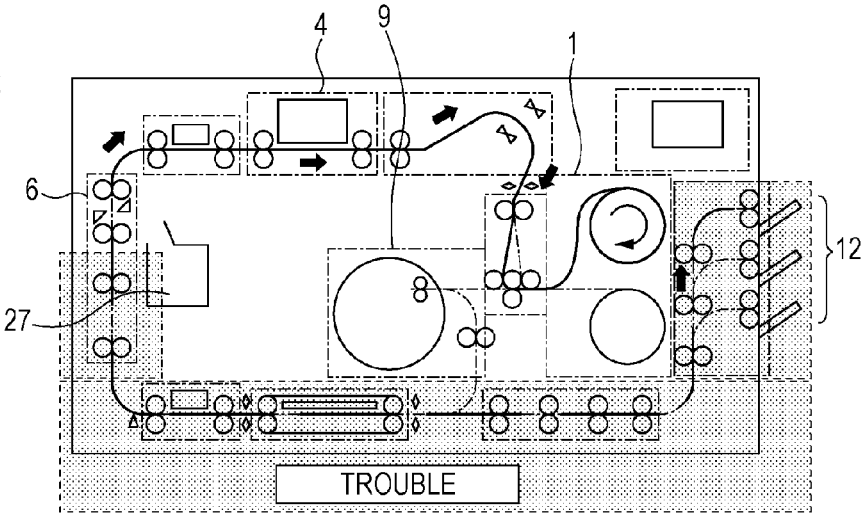
Figure 9A:
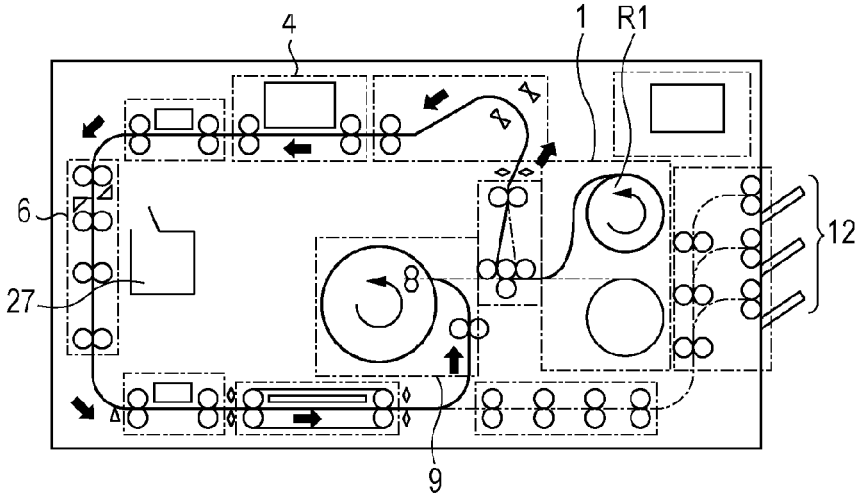
FIGS. 9A to 9C are diagrams illustrating a sheet conveying state during front-surface printing in a duplex printing mode and jam states.
Figure 9B:
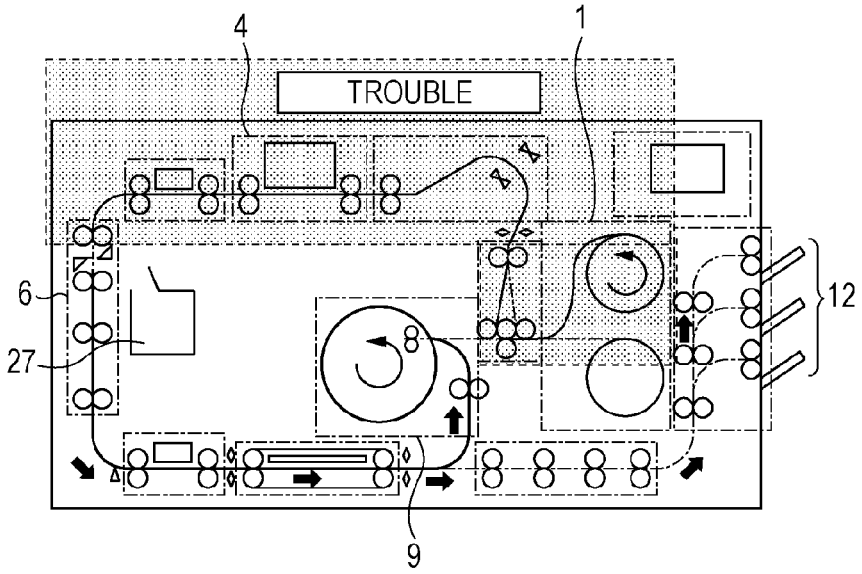
Figure 9C:
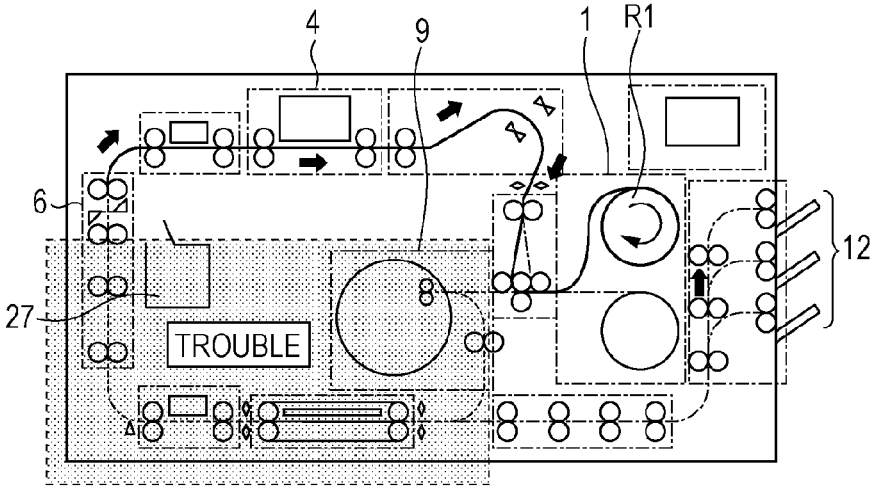
Figure 10A:
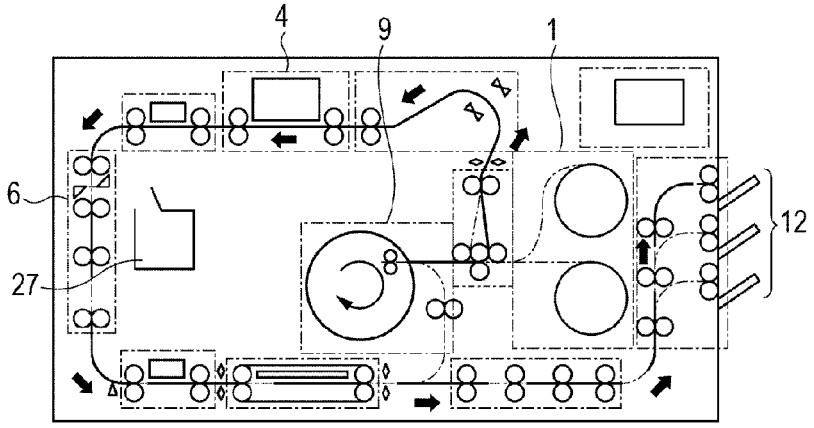
FIGS. 10A to 10C are diagrams illustrating a sheet conveying state during rear-surface printing in the duplex printing mode and jam states.
Figure 10B:
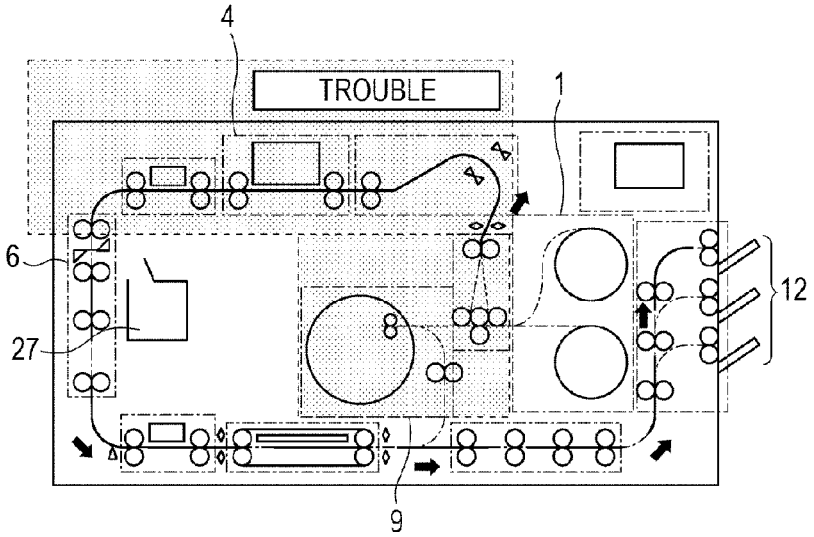
Figure 10C:
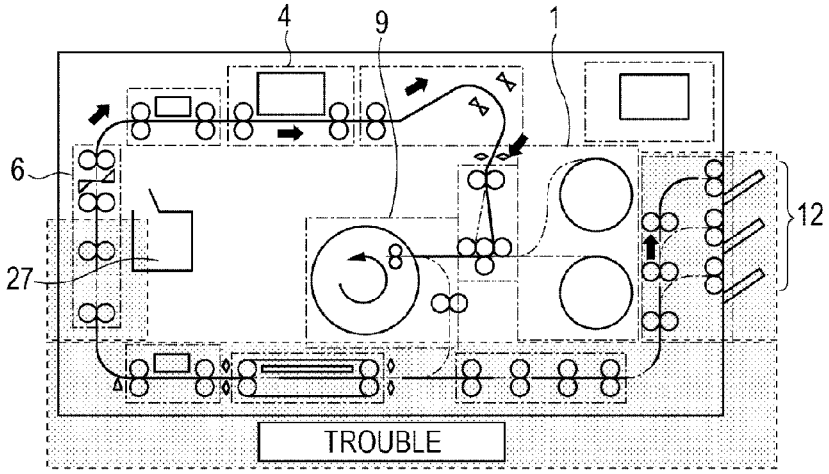

States of sheet conveyance jams occurred in the printing apparatus with the above-described structure and a jam recovery operation will now be described. FIG. 8A illustrates a sheet conveying state during printing in the single-side printing mode. FIG. 8B illustrates a case where a jam has occurred in the path upstream of the cutter unit 6. FIG. 8C illustrates a case where a jam has occurred in the path downstream of the cutter unit 6. In FIGS. 8B and 8C, each halftone portion is a region where the trouble has occurred. The operator has to remove a sheet in this region. FIG. 9A illustrates a sheet conveying state during front-surface printing in the duplex printing mode. FIG. 9B illustrates a case where a jam has occurred in the path upstream of the cutter unit 6. FIG. 9C illustrates a case where a jam has occurred in the path downstream of the cutter unit 6. FIG. 10A illustrates a sheet conveying state during rear-surface printing in the duplex printing mode. FIG. 10B illustrates a case where a jam has occurred in the path upstream of the cutter unit 6. FIG. 10C illustrates a case where a jam has occurred in the path downstream of the cutter unit 6. In each of the cases in the diagrams, a halftone portion is a region where the trouble has occurred. The operator has to remove the sheet in this region.

The printing apparatus includes a jam detecting unit configured to detect a sheet conveyance jam during printing and the position of the jam. As for a jam detecting method used by the jam detecting unit, a method of detecting abnormal conveyance on the basis of the leading edge of a sheet or a method of detecting abnormal conveyance on the basis of the middle of a sheet is available. According to the former method, position information regarding the theoretical leading edge of a sheet calculated based on roller control information is checked against a result of detection by a sheet sensor disposed between adjacent rollers. When the sheet sensor does not detect the leading edge of a sheet within a time period during which the leading edge will pass, or when the detection is too late relative to a theoretical value, it is determined that a jam has occurred. According to the latter method, if a conveyance failure occurs in any portion of a continuous sheet moving in the sheet conveying path, the speed of this portion is lowered. In the worst case, the speed of this portion is lowered to zero. The succeeding sheet following this portion is fed, so that the sheet is accumulated to make a loop. According to a technique of detecting such a state, when a reduction in the number of revolutions of a motor for the conveying rollers or abnormal motor load occurs, it can be determined that a jam has occurred. According to another method, direct sensors configured to directly measure moving conditions (a speed and a distance) of the surface of a sheet are arranged in the sheet conveying path. If an abnormal sheet conveyance speed is detected, it can be determined that a jam has occurred. According to further another method, a sensor measures the size of a loop in a portion, where the loop is intentionally formed, in the sheet conveying path. When the size of the loop differs from a predetermined size, it can be determined that a jam has occurred.

When the jam detecting unit detects a jam, the control unit 13 stops driving motors for all of the conveying rollers associated with the sheet conveyance in the sheet conveying path. This reason is that the effect of the jam is kept within a portion where the jam has occurred in order to prevent the jam from affecting another portion. The control unit 13 allows the operation section 15 or a display of the host device 16 to display the portion where the jam has occurred and an operating instruction, thus prompting the operator to manually perform a jam recovery process.

Figure 11:
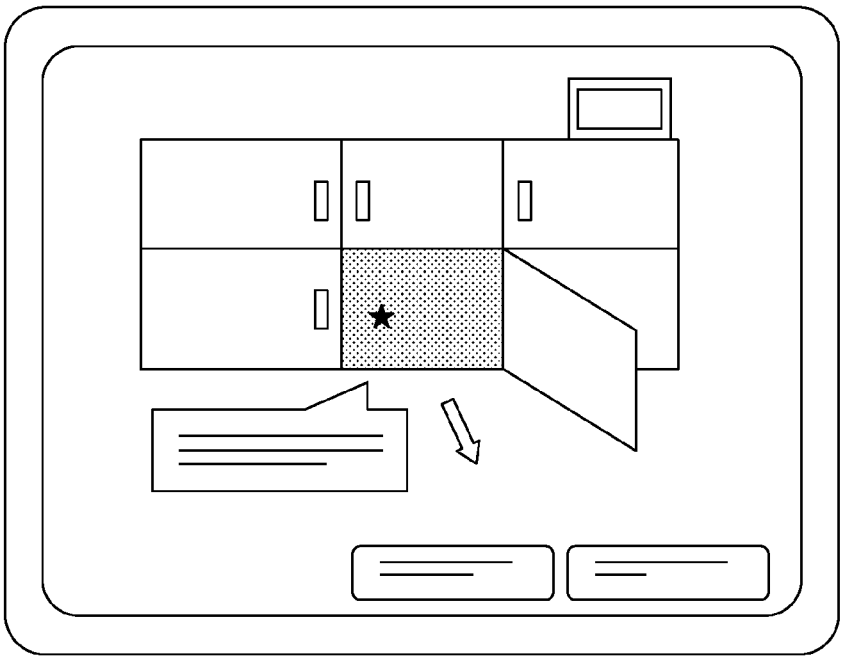
FIG. 11 illustrates a display example of maintenance information upon occurrence of a jam.

FIG. 11 illustrates a display example on the display. A unit to be pulled out of the main body of the printing apparatus by the operator, a maintenance door to be opened in association with the unit, and a hand cutter to be manipulated in order to cut the sheet are graphically displayed with an operating procedure. If there are a plurality of maintenance doors to be opened and a plurality of hand cutters to be manipulated, the manipulation sequence of the doors and hand cutters is also displayed.

The operator performs the manual jam recovery process of manually removing the sheet remaining in a region where a trouble has occurred in accordance with this operating instruction. In the following description, it is assumed that a jam has occurred in a region including the drying unit 8 during first-side printing in the duplex printing mode. In other words, the case illustrated in FIG. 9C will be described as an example. The same concept applies to the units other than the drying unit 8.

Figures 12A, 12B, 12C, 12D:
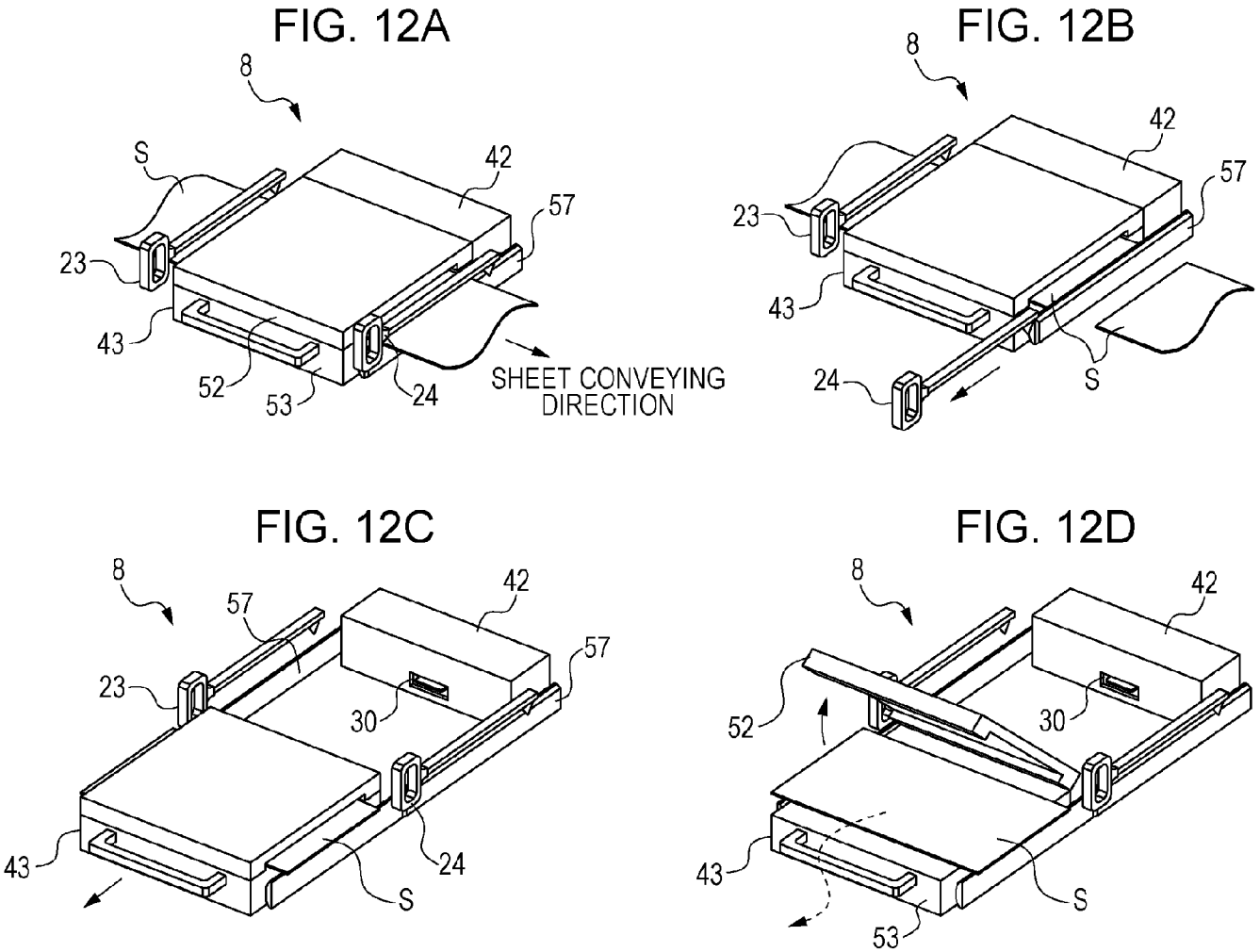
FIGS. 12A to 12D are diagrams explaining a manual jam recovery process in the drying unit.

During first-side printing in the duplex printing mode, the continuous sheet passes through the drying unit 8 (refer to FIG. 12A). When a jam occurs at this time, the continuous sheet stops such that the sheet extends over the drying unit 8. If the operator tries to pull the drying unit 8 in order to resolve the jam, it is difficult to smoothly the drying unit 8 because the continuous sheet remaining in the sheet conveying path is caught. If the drying unit 8 is pulled by force, the sheet is drawn by force, so that the drying unit 8 and the adjacent units may be damaged, alternatively, the sheet may be torn and a piece of the torn sheet may be left in a place from which the piece cannot be removed. Prior to pulling the drying unit 8, therefore, the operator manipulates the seventh cutter 23 and the eighth cutter 24 arranged near the drying unit 8 on the upstream and downstream of the drying unit 8 to cut the continuous sheet in two positions upstream and downstream of the drying unit 8 (refer to FIG. 12B). After that, the operator pulls a part (the conveying portion 43) of the drying unit 8 out of the main body of the printing apparatus along the rails 57. The drying unit 8 can be smoothly pulled while the sheet is not caught because the sheet is cut (refer to FIG. 12C). Then, the operator opens the first housing segment 52 of the pulled drying unit 8 and removes a sheet piece remaining in the internal conveying mechanism to resolve the jam (refer to FIG. 12D). After such an operation, the operator closes the first housing segment 52 and returns the drying unit 8 to the original position in the main body of the printing apparatus. When the maintenance door is closed, the jam detecting unit again determines a jam state. If the jam detecting unit still detects a jam, the printing apparatus issues an alert to prompt the operator to again perform the manual jam recovery process. If the jam detecting unit detects no jam, the printing apparatus determines that the jammed sheet has been removed, terminates such a maintenance mode, and returns to the printing operation mode.

During printing in the single-side printing mode or during second-side printing in the duplex printing mode, a sheet segment, having a unit image, cut by the cutter unit 6 passes through the drying unit 8. If a jam occurs and the conveyance is stopped, the sheet remaining in the drying unit 8 has already been cut (refer to FIGS. 8A to 8C and 10A to 10C). Accordingly, the operator doesn't have to cut the sheet using the hand cutters and can pull the drying unit 8. In other words, the sheet cutting step illustrated in FIG. 12B can be omitted. As for display on the display illustrated in FIG. 11, if a jam in the drying unit 8 is detected during second-side printing in the duplex printing mode or during printing in the single-side printing mode, the unit (the drying unit 8) to be pulled in the jam recovery process is displayed on the display and information indicating that it is unnecessary to manipulate the hand cutters is also displayed. Whereas, if a jam is detected during first-side printing in the duplex printing mode, the unit to be pulled in the jam recovery process and the cutters to be manipulated in association with the unit are displayed on the display, thus prompting the operator to perform the manual jam recovery process. The same applies to a case where a jam in the drying unit 8 is detected during second-side printing in the duplex printing mode or during printing in the single-side printing mode.

The main body of the printing apparatus includes a lock mechanism configured to prevent the drying unit 8 from being pulled in order to increase the safety for the operator. Since the inside of the drying unit 8 is at high temperature during running, the lock mechanism is locked so that the drying unit 8 cannot be pulled at least during the printing operation (while the drying unit 8 is running). After the jam detecting unit detects a jam during first-side printing in the duplex printing mode, the lock mechanism is unlocked so that the operator can pull the drying unit 8. The lock mechanism may be locked to prevent the first housing segment 52 from being opened relative to the second housing segment 53.

According to the above-described embodiment, even when a jam occurs during printing and a continuous sheet is stopped while the sheet extends over units, the continuous sheet can be cut using cutters and the unit can be reliably pulled. Consequently, the apparatus can return to the printing operation mode at little expense in time and effort while it is easy for the operator to perform the jam recovery operation, resulting in excellent ease of maintenance.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-099149 filed Apr. 22, 2010, which is hereby incorporated by reference herein in its entirety.

What is claimed is:

1. An apparatus for performing printing on a continuous sheet, the apparatus comprising:

a main body;

a printing unit;

a drying unit having a housing, wherein the drying unit is configured to dry a continuous sheet subjected to printing by the printing unit, wherein the printing unit and the drying unit are disposed in the main body, and wherein the housing of the drying unit is capable of being pulled out of the main body; and a first cutter and a second cutter each provided outside of the housing of the drying unit, wherein the continuous sheet travels along a conveyance path, wherein the first cutter is configured to cut the continuous sheet in an upstream direction of the conveyance path, wherein the upstream direction is upstream of the housing, wherein the second cutter is configured to cut the continuous sheet in a downstream direction of the conveyance path, where the downstream direction is downstream of the housing, wherein, along the conveyance path, no conveyance roller exists between the first cutter and the housing, and wherein, along the conveyance path, no conveyance roller exists between the second cutter and the housing;

wherein the drying unit has a heater portion and a conveying mechanism for sheet conveyance provided in the housing, wherein the heater portion is connected to a conveying portion of the conveying mechanism through a drawer connector, wherein the housing comprises a first segment that holds an upper part of the conveying mechanism and a second segment that holds a lower part of the conveying mechanism, and wherein the housing has a structure in which a front portion of the housing is openable such that the first segment is rotatable with respect to the second segment about a hinge disposed at a back of the housing in a direction in which the housing is pulled out of the main body, and wherein, when the housing is pulled out of the main body after the continuous sheet is cut by the first cutter and the second cutter, a part of the heater portion remains inside the main body, and then, when the first segment of the housing is in an open state with respect to the second segment, the upper part and the lower part of the conveying mechanism are separated and a sheet sandwiched therebetween is released.

2. The apparatus according to claim 1, wherein the housing is provided with the drawer connector at least for power supply from the heater portion, and when the housing is pulled out of the main body, connection through the drawer connector is cut.

3. The apparatus according to claim 1, further comprising:

a unit configured to prompt an operator to, when a sheet conveyance jam has been detected, perform a manual recovery process appropriate to a location where the sheet conveyance jam has occurred.

4. The apparatus according to claim 3, wherein the main body includes a plurality of maintenance doors which are independently openable and closable, and wherein when the sheet conveyance jam has been detected, the maintenance door to be opened in association with a processing unit in which the sheet conveyance jam has occurred and an operating procedure are displayed on a display.

5. The apparatus according to claim 1, further comprising:

a lock mechanism configured to be locked so as to prevent the drying unit from being pulled out of the main body, wherein the lock mechanism is locked at least during printing, and after a jam is detected during sheet conveyance, the lock mechanism is unlocked.

6. The apparatus according to claim 1, wherein the apparatus includes:

a feeding unit configured to feed a continuous sheet along the conveyance path;

a cutter unit, disposed downstream of the printing unit in the conveyance path, configured to cut the sheet; and a reverse unit configured to reverse, along the conveyance path, a sheet that has passed through the drying unit.

7. The apparatus according to claim 6, wherein, in a duplex printing, the printing unit prints a plurality of images on a first surface of the continuous sheet that is fed from the feeding unit;

the continuous sheet that has been printed on the first surface passes through the drying unit and is led to the reverse unit;

the reverse unit reverses the continuous sheet and feeds the reversed continuous sheet to the printing unit;

the printing unit prints a plurality of images on a second surface, which is the back of the first surface, of the continuous sheet that was fed from the reverse unit;

the cutter unit cuts the continuous sheet printed on the second surface into a plurality of cut sheets; and the cut sheets pass through the drying unit and are ejected.

8. An apparatus for performing printing on a continuous sheet, the apparatus comprising:

a main body;

a printing unit that is disposed in the main body;

a drying unit that has a housing and that is disposed in the main body, wherein the drying unit is configured to dry a continuous sheet subjected to printing by the printing unit, wherein the housing of the drying unit is capable of being pulled out of the main body, wherein the drying unit has a heater portion and a conveying mechanism for sheet conveyance provided in the housing, wherein the heater portion is connected to a conveying portion of the conveying mechanism through a drawer connector, wherein the housing comprises a first segment that holds an upper part of the conveying mechanism and comprises a second segment that holds a lower part of the conveying mechanism, and wherein the housing is openable such that the first segment is rotatable with respect to the second segment about a hinge; and a first cutter and a second cutter each provided outside of the housing of the drying unit, wherein the continuous sheet travels along a conveyance path, wherein the first cutter is configured to cut the continuous sheet in an upstream direction of the conveyance path, wherein the upstream direction is upstream of the housing, wherein the second cutter is configured to cut the continuous sheet in a downstream direction of the conveyance path, wherein the downstream direction is downstream of the housing, wherein, along the conveyance path, no conveyance roller exists between the first cutter and the housing, wherein, along the conveyance path, no conveyance roller exists between the second cutter and the housing, and wherein, when the housing is pulled out of the main body after the continuous sheet has been cut by the first cutter and has been cut by the second cutter, a part of the heater portion remains inside the main body, and, when the first segment of the housing is in an open state with respect to the second segment, the upper part and the lower part of the conveying mechanism are separated.

* * * * *